US007675383B2

(12) United States Patent
Hangai et al.

(10) Patent No.: US 7,675,383 B2
(45) Date of Patent: Mar. 9, 2010

(54) SWITCH CIRCUIT

(75) Inventors: Masatake Hangai, Tokyo (JP); Tamotsu Nishino, Tokyo (JP); Shinnosuke Soda, Tokyo (JP); Kenichi Miyaguchi, Tokyo (JP); Kenji Kawakami, Tokyo (JP); Masaomi Tsuru, Tokyo (JP); Satoshi Hamano, Tokyo (JP); Moriyasu Miyazaki, Tokyo (JP); Tadashi Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1 day.

(21) Appl. No.: 11/795,335

(22) PCT Filed: Jan. 27, 2005

(86) PCT No.: PCT/JP2005/001081

§ 371 (c)(1),
(2), (4) Date: Jul. 16, 2007

(87) PCT Pub. No.: WO2006/080062

PCT Pub. Date: Aug. 3, 2006

(65) Prior Publication Data

US 2008/0136557 A1 Jun. 12, 2008

(51) Int. Cl.
*H01P 1/10* (2006.01)
*H01H 9/54* (2006.01)

(52) U.S. Cl. ..... 333/105; 333/101

(58) Field of Classification Search ..... 333/101, 333/102, 103, 104, 105, 262
See application file for complete search history.

(56) References Cited

U.S. PATENT DOCUMENTS

| | | | | |
|---|---|---|---|---|
| 4,249,150 | A * | 2/1981 | Bickley et al. | 333/262 |
| 4,894,720 | A * | 1/1990 | Kamada | 348/706 |
| 5,140,700 | A | 8/1992 | Kennedy | |
| 5,808,527 | A | 9/1998 | De Los Santos | |
| 6,472,962 | B1 | 10/2002 | Guo et al. | |

(Continued)

FOREIGN PATENT DOCUMENTS

EP 1 220 460 A2 3/2002

(Continued)

OTHER PUBLICATIONS

Pacheco et al., "MEMS Single-Pole Double-Throw (SPDT) X and K-Band Switching Cirtuits," Radiation Laboratory, Dept. of Elec. Engineering and Comp. Sci., IEEE, 2001, pp. 1-4.

(Continued)

*Primary Examiner*—Dean O Takaoka
(74) *Attorney, Agent, or Firm*—Birch, Stewart, Kolasch, Birch, LLP.

(57) ABSTRACT

A switch circuit includes: a first input and output terminal; a first inductor connected with the first input and output terminal; a capacitor connected with the first inductor; a second input and output terminal connected with the capacitor; a first MEMS switch connected with one end of the capacitor; a second MEMS switch connected with the other end of the capacitor; and a second inductor connected between the first MEMS switch and the second MEMS switch, and satisfies a relationship of $f=1/(2\pi\sqrt{CL_1})=1/(2\pi\sqrt{CL_2})$, where $L_1$ is an inductance of the first inductor, $L_2$ is an inductance of the second inductor, C is a capacitance of the capacitor, and f is a use frequency.

5 Claims, 12 Drawing Sheets

U.S. PATENT DOCUMENTS 7,084,717 B2 * 8/2006 Okazaki et al. ..... 333/118

FOREIGN PATENT DOCUMENTS

JP 10-107570 A 4/1998
JP 2004-159322 A 6/2004
JP 2004-327877 A 11/2004
JP 2004-328561 A 11/2004

OTHER PUBLICATIONS

Peroulis, D. et al., "MEMS Devices for High Isolation Switching and Tunable Filtering" 2000 IEEE MTT-S International, vol. 2, Jun. 2000, pp. 1217-1220. XP-010507557.

* cited by examiner

SWITCH CIRCUIT

TECHNICAL FIELD

The present invention relates to a switch circuit which has a small size, a low loss, and high isolation at a high frequency, such as a single-pole single-throw switch, a single-pole double-throw switch, or a multi-pole multi-throw switch.

BACKGROUND ART

According to a conventional single-pole double-throw (SPDT) switch, when two microelectromechanical systems (MEMS) switches are separately controlled, a path of a high-frequency signal inputted to an input terminal can be controlled for two output terminals (see, for example, Non-patent Document 1).

Non-patent Document 1: Sergio P. Pacheco, Dimitrios Peroulis, and Linda P. B. Katehi, "MEMS Single-Pole Double-Throw (SPDT) X and K-Band Switching Circuits", IEEE MTT-S, 2001

DISCLOSURE OF THE INVENTION

Problems to be Solved by the Invention

The conventional single-pole double-throw (SPDT) switch has a problem that it is disadvantageous to reduce a circuit size and a loss because two-system control signal lines and two-system λg/4 lines are required to separately control the two MEMS switches.

The present invention has been made to solve the above-mentioned problem and an object of the present invention is to obtain a switch circuit capable of realizing a small size, a low loss, and high isolation at a high frequency.

Means for Solving the Problem

A switch circuit according to the present invention includes: a first input and output terminal; a first inductor connected with the first input and output terminal; a capacitor connected with the first inductor; a second input and output terminal connected with the capacitor; a first MEMS switch connected with one end of the capacitor; a second MEMS switch connected with the other end of the capacitor; and a second inductor connected between the first MEMS switch and the second MEMS switch, and in the switch circuit, a relationship of $f=1/(2\pi\sqrt{CL_1})=1/(2\pi\sqrt{CL_2})$ is satisfied, where $L_1$ is an inductance of the first inductor, $L_2$ is an inductance of the second inductor, C is a capacitance of the capacitor, and f is a use frequency.

Further, a switch circuit according to the present invention includes: a substrate including a cavity; a second electrode formed to a surface of the cavity; a second inductor formed to the surface of the cavity; a support film formed on the substrate to cover a space of the cavity; a first electrode formed on the support film; a first input and output terminal formed on the support film; a first inductor which is formed on the support film and connected with the first input and output terminal; a capacitor which is formed on the support film and connected with the first inductor; a second input and output terminal which is formed on the support film and connected with the capacitor; and first and second MEMS switches for displacing the support film by an electrostatic force acting between the second electrode and the first electrode in response to a control signal applied to the second electrode to make one end of the first inductor and one end of the second inductor into one of a contact state and a non-contact state and to make the second input and output terminal and the other end of the second inductor into the one of the contact state and the non-contact state, and in the switch circuit, a relationship of $f=1/(2\pi\sqrt{CL_1})=1/(2\pi\sqrt{CL_2})$ is satisfied, where $L_1$ is an inductance of the first inductor, $L_2$ is an inductance of the second inductor, C is a capacitance of the capacitor, and f is a use frequency.

EFFECTS OF THE INVENTION

The switch circuit according to the present invention has an effect capable of realizing a small size, a low loss, and high isolation at a high frequency.

BEST MODE FOR CARRYING OUT THE INVENTION

Hereinafter, Embodiments 1 to 6 will be described. Embodiments 3 and 4 correspond to Embodiments 1 and 2 relate to specific structures. Embodiment 6 corresponds to Embodiment 5 and relates to a specific structure.

Embodiment 1

Figure 1:
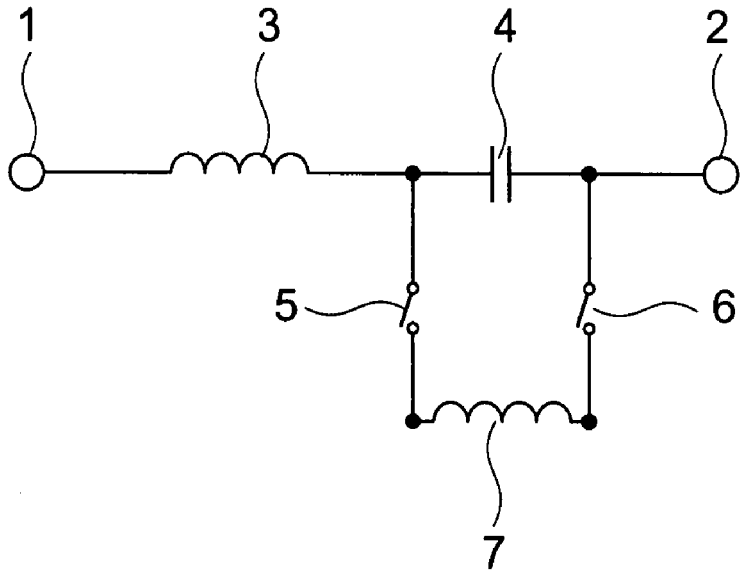
FIG. 1 is a circuit diagram showing a structure of a single-pole single-throw switch according to Embodiment 1 of the present invention.

A switch circuit according to Embodiment 1 of the present invention will be described with reference to FIGS. 1 to 3. FIG. 1 is a circuit diagram showing a structure of a single-pole single-throw switch according to Embodiment 1 of the present invention. Note that, in each of the figures, the same reference numerals denote the same or corresponding portions.

In FIG. 1, the single-pole single-throw switch according to Embodiment 1 includes a first input and output terminal 1, a second input and output terminal 2, a first inductor 3 connected with the first input and output terminal 1, a capacitor 4 connected between the first inductor 3 and the second input and output terminal 2, a first MEMS switch 5 connected with one end of the capacitor 4, a second MEMS switch 6 connected with the other end of the capacitor 4, and a second inductor 7 connected between the first MEMS switch 5 and the second MEMS switch 6.

Next, the operation of the switch circuit according to Embodiment 1 will be described with reference to the drawings.

Figure 2:
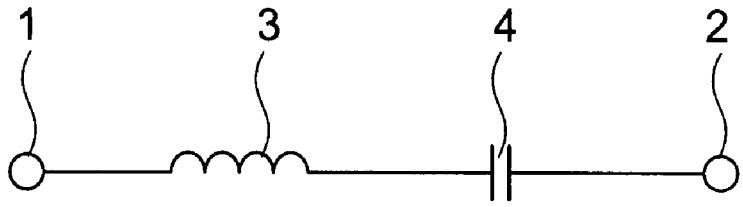
FIG. 2 is an equivalent circuit diagram showing the single-pole single-throw switch of FIG. 1.

FIG. 2 is an equivalent circuit diagram in the case where each of the first and second MEMS switches 5 and 6 is in an off (OFF) state. When an inductance $L_1$ of the first inductor 3, an inductance $L_2$ of the second inductor 7, and a capacitance C of the capacitor 4 are set so as to satisfy a relationship of "$f=1/(2\pi\sqrt{CL_1})=1/(2\pi\sqrt{CL_2})$" at a use frequency f, a high-frequency signal inputted from the first input and output terminal 1 is outputted to the second input and output terminal 2. At this time, the single-pole single-throw switch becomes an on (ON) state.

Figure 3:
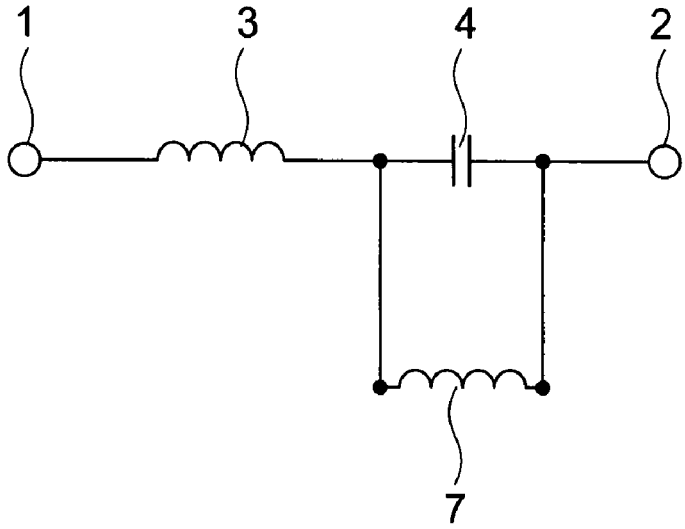
FIG. 3 is an equivalent circuit diagram showing the single-pole single-throw switch of FIG. 1.

FIG. 3 is an equivalent circuit diagram in the case where each of the first and second MEMS switches 5 and 6 is in the on (ON) state. At this time, the single-pole single-throw switch becomes the off (OFF) state.

Embodiment 2

Figure 4:
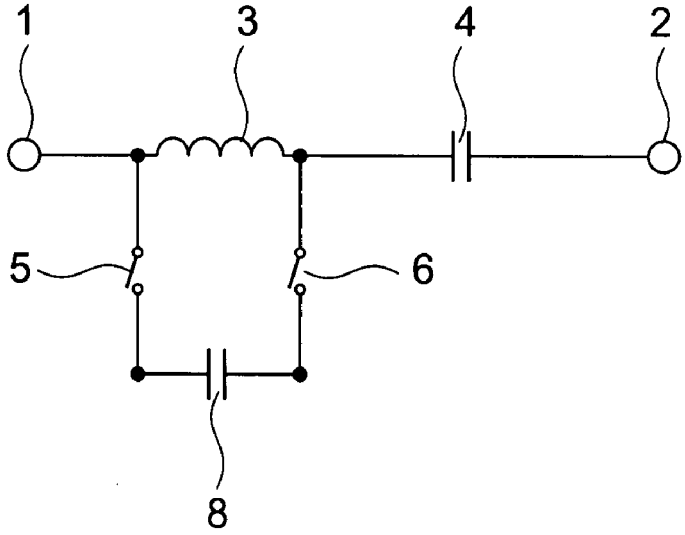
FIG. 4 is a circuit diagram showing a structure of a single-pole single-throw switch according to Embodiment 2 of the present invention.

A switch circuit according to Embodiment 2 of the present invention will be described with reference to FIGS. 4 to 6. FIG. 4 is a circuit diagram showing a structure of a single-pole single-throw switch according to Embodiment 2 of the present invention.

In FIG. 4, the single-pole single-throw switch according to Embodiment 2 includes a first input and output terminal 1, the second input and output terminal 2, the inductor 3 connected with the first input and output terminal 1, the first capacitor 4 connected between the inductor 3 and the second input and output terminal 2, a first MEMS switch 5 connected with one end of the first capacitor 4, a second MEMS switch 6 connected with the other end of the first capacitor 4, and a second capacitor 8 connected between the first MEMS switch 5 and the second MEMS switch 6.

Next, the operation of the switch circuit according to Embodiment 2 will be described with reference to the drawings.

Figure 5:
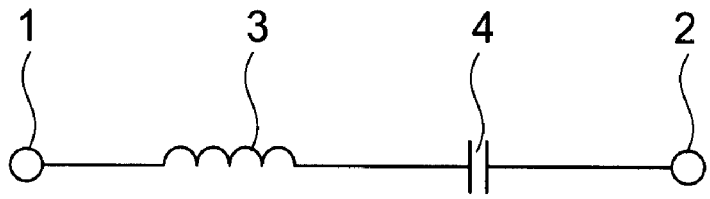
FIG. 5 is an equivalent circuit diagram showing the single-pole single-throw switch of FIG. 4.

FIG. 5 is an equivalent circuit diagram in the case where each of the first and second MEMS switches 5 and 6 is in an off (OFF) state. When an inductance L of the inductor 3, a capacitance $C_1$ of the first capacitor 4, and a capacitance $C_2$ of the second capacitor 8 are set so as to satisfy a relationship of "$f=1/(2\pi\sqrt{C_1L})=1/(2\pi\sqrt{C_2L})$" at a use frequency f, a high-frequency signal inputted from the first input and output terminal 1 is outputted to the second input and output terminal 2. At this time, the single-pole single-throw switch becomes an on (ON) state.

Figure 6:
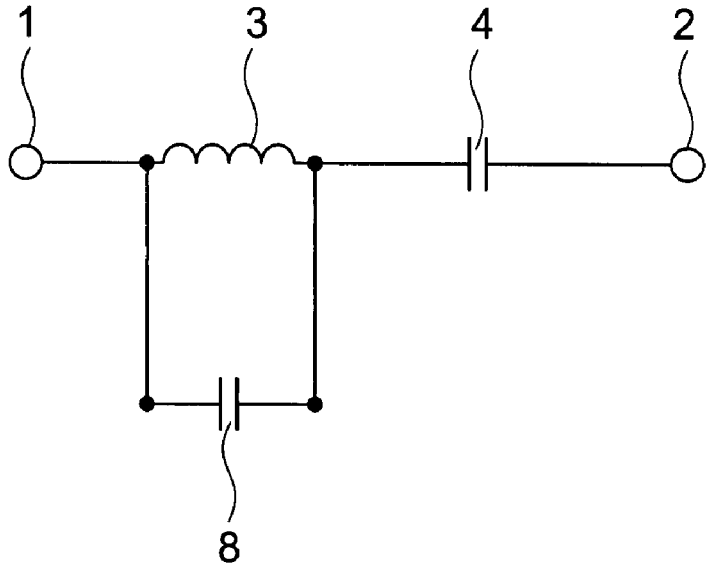
FIG. 6 is an equivalent circuit diagram showing the single-pole single-throw switch of FIG. 4.

FIG. 6 is an equivalent circuit diagram in the case where each of the first and second MEMS switches 5 and 6, is in the on (ON) state. At this time, the single-pole single-throw switch becomes the off (OFF) state.

Embodiment 3

Figure 7:
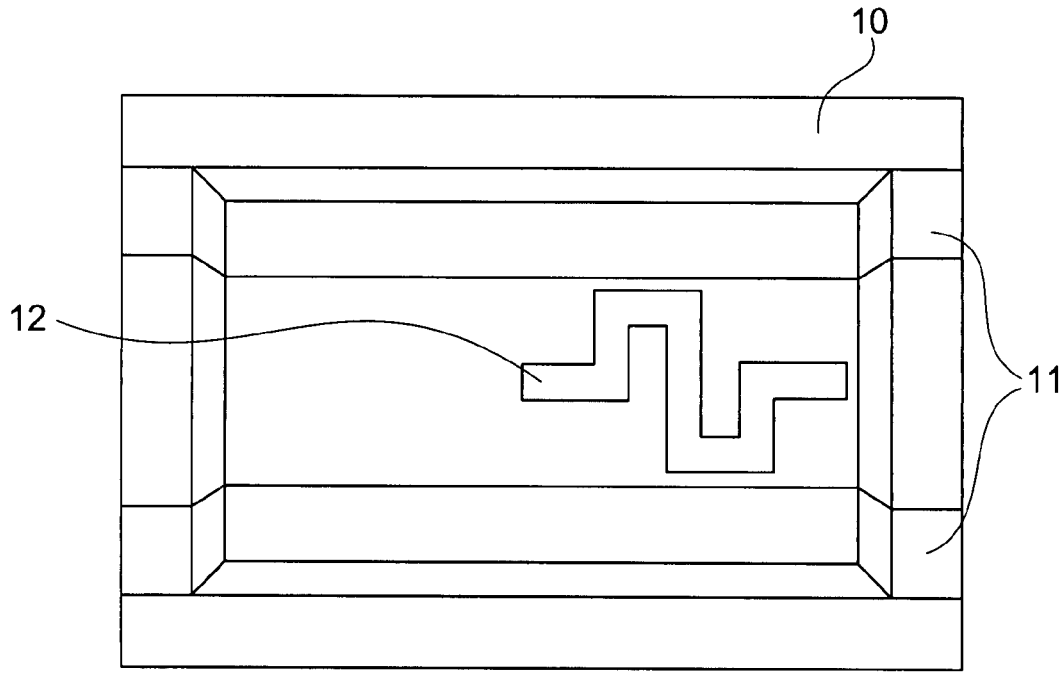
FIG. 7 is a plan view showing a structure of a single-pole single-throw switch according to Embodiment 3 of the present invention.
Figure 8:
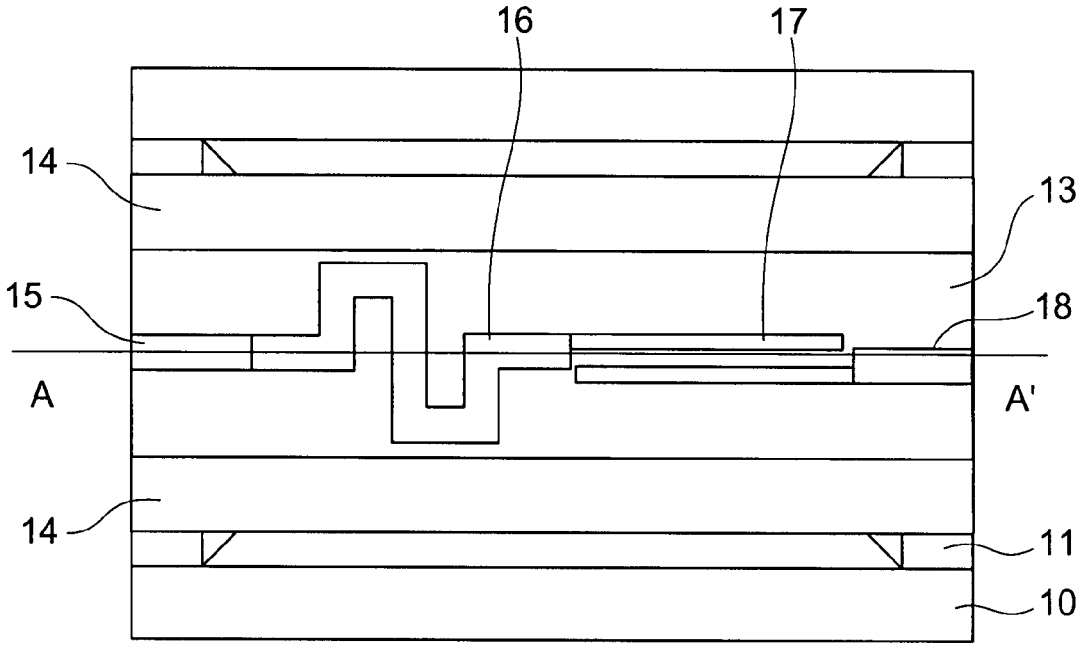
FIG. 8 is a plan view showing a structure of the single-pole single-throw switch according to Embodiment 3 of the present invention.

A switch circuit according to Embodiment 3 of the present invention will be described with reference to FIGS. 7 to 10. FIGS. 7 and 8 are plan views showing a structure of a single-pole single-throw switch according to Embodiment 3 of the present invention.

FIG. 7 is a structural view showing a single-pole single-throw switch which does not include a support film. FIG. 8 is a structural view showing a single-pole single-throw switch which includes a support film.

Figure 9:
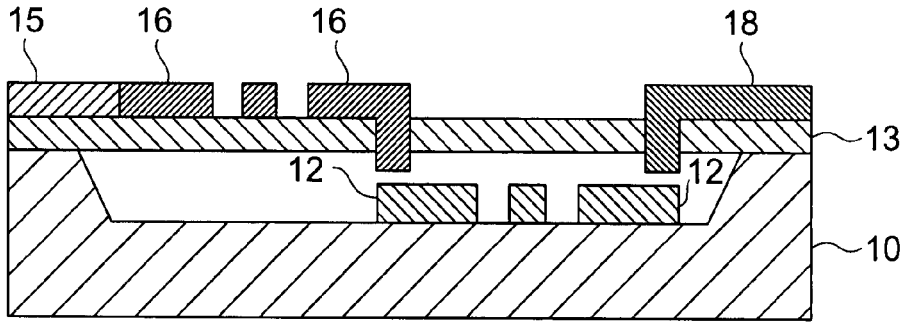
FIG. 9 is a cross sectional view showing an A-A' cross section of the single-pole single-throw switch of FIG. 8.
Figure 10:
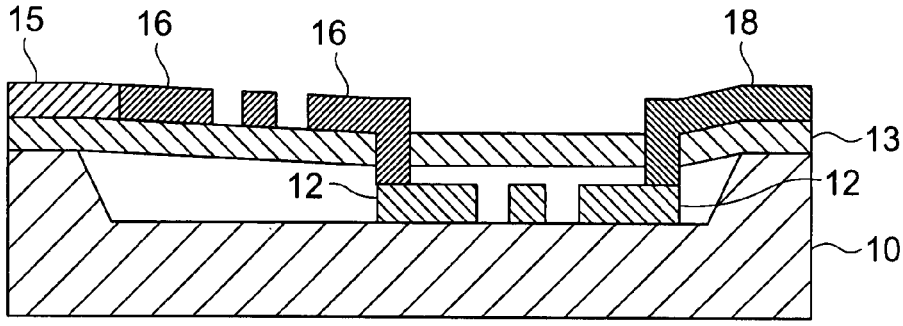
FIG. 10 is a cross sectional view showing the A-A' cross section of the single-pole single-throw switch of FIG. 8.

In FIGS. 7 and 8, the single-pole single-throw switch according to Embodiment 3 includes a substrate 10 whose central part has a rectangular concave portion (cavity) like a rectangular ashtray, a second electrode 11 formed in the concave portion, a second inductor 12 formed in the concave portion, a support film 13 formed on the substrate 10 so as to cover the concave portion, a first electrode 14 formed on the support film 13, a first input and output terminal 15, a first inductor 16, a capacitor 17, and a second input and output terminal 18. As shown in FIGS. 9 and 10 described later, an end of the first inductor 16 which is located on the capacitor 17 side extends through the support film 13 and serves as a leg portion thereof. As shown in FIGS. 9 and 10 described later, an end of the second input and output terminal 18 which is located on the capacitor 17 side extends through the support film 13 and serves as a leg portion thereof.

The first input and output terminal 15, the second input and output terminal 18, the first inductor 16, the capacitor 17, and the second inductor 12, which are described in Embodiment 3, correspond to the first input and output terminal 1, the second input and output terminal 2, the first inductor 3, the capacitor 4, and the second inductor 7, respectively, which are described in Embodiment 1.

Next, the operation of the switch circuit according to Embodiment 3 will be described with reference to the drawings.

FIG. 10 is a cross sectional view along an A-A' line of FIG. 8 in the case where a control signal is applied to the second electrode 11. The support layer 13 is displaced by an electrostatic force acting between the second electrode 11 and the first electrode 14 according to the control signal applied to the second electrode 11. Therefore, one end of the capacitor 17 (that is, the leg portion of the first inductor 16) and one end of the second inductor 12 are made into a contact state (each of the first and second MEMS switches is in the on (ON) state) at least two contacts. The other end of the capacitor 17 (that is, the leg portion of the second input and output terminal 18) and the other end of the second inductor 12 are made into the contact state at least two contacts.

In this case, when the inductance $L_1$ of the first inductor 16, the inductance $L_2$ of the second inductor 12, and the capacitance C of the capacitor 17 are set so as to satisfy a relationship of "$f=\frac{1}{2}\pi\sqrt{CL_1}=\frac{1}{2}\pi\sqrt{CL_2}$" at a use frequency f, a high-frequency signal inputted from the first input and output terminal 15 is outputted to the second input and output terminal 18. At this time, the single-pole single-throw switch becomes an off (OFF) state.

FIG. 9 is a cross sectional view along the A-A' line of FIG. 8 in the case where the control signal is not applied to the second electrode 11. At this time, the single-pole single-throw switch becomes the on (ON) state.

Embodiment 4

Figure 11:
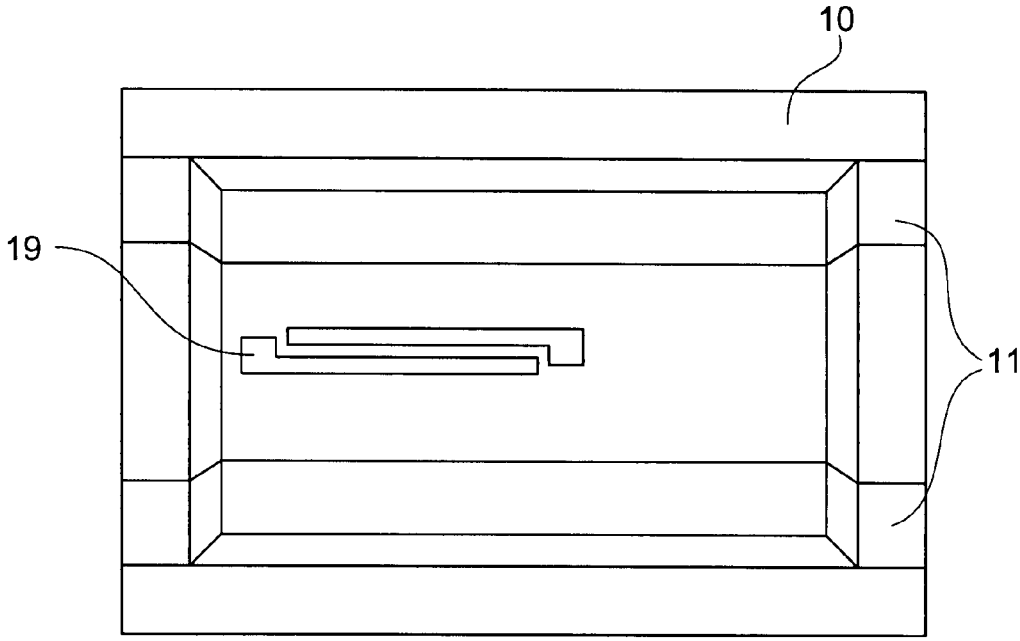
FIG. 11 is a plan view showing a structure of a single-pole single-throw switch according to Embodiment 4 of the present invention.
Figure 12:
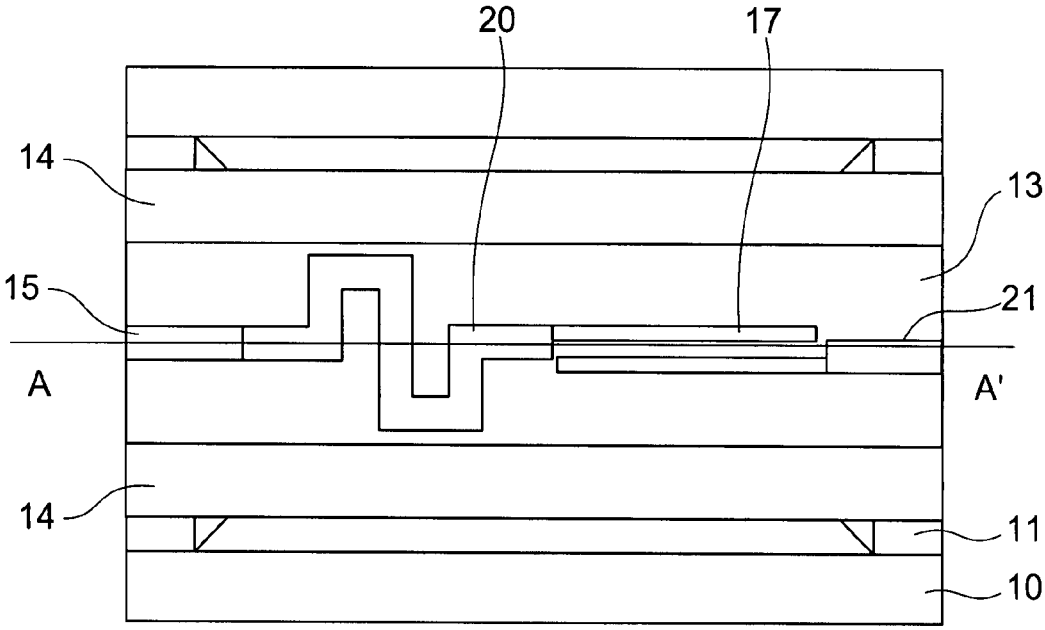
FIG. 12 is a plan view showing a structure of the single-pole single-throw switch according to Embodiment 4 of the present invention.

A switch circuit according to Embodiment 4 of the present invention will be described with reference to FIGS. 11 to 14. FIGS. 11 and 12 are plan views showing a structure of a single-pole single-throw switch according to Embodiment 4 of the present invention.

FIG. 11 is a structural view showing a single-pole single-throw switch which does not include a support film. FIG. 12 is a structural view showing a single-pole single-throw switch which includes a support film.

Figure 13:
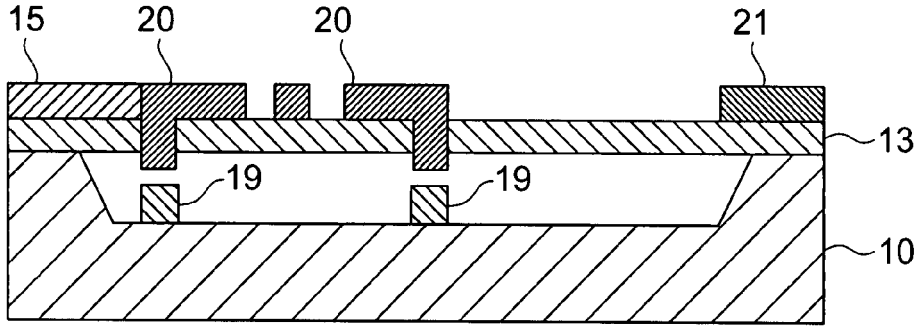
FIG. 13 is a cross sectional view showing an A-A' cross section of the single-pole single-throw switch of FIG. 12.
Figure 14:
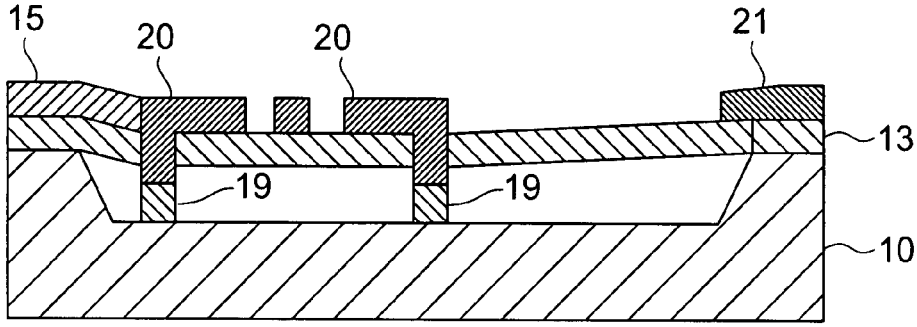
FIG. 14 is across sectional view showing the A-A' cross section of the single-pole single-throw switch of FIG. 12.

In FIGS. 11 and 12, the single-pole single-throw switch according to Embodiment 4 includes a substrate 10 whose central part has a rectangular concave portion (cavity) like a rectangular ashtray, a second electrode 11 formed in the concave portion, a second capacitor 19 formed in the concave portion, the support film 13 formed on the substrate 10 so as to cover the concave portion, a first electrode 14 formed on the support film 13, the first input and output terminal 15, an inductor 20, the first capacitor 17, and a second input and output terminal 21. As shown in FIGS. 13 and 14 described later, both ends of the first inductor 20 extend through the support film 13 and serve as leg portions thereof.

The first input and output terminal 15, the second input and output terminal 21, the inductor 20, the first capacitor 17, and the second capacitor 19, which are described in Embodiment 4, correspond to the first input and output terminal 1, the second input and output terminal 2, the inductor 3, the first capacitor 4, and the second capacitor 8, respectively, which are described in Embodiment 2.

Next, the operation of the switch circuit according to Embodiment 4 will be described with reference to the drawings.

FIG. 14 is a cross sectional view along an A-A' line of FIG. 12 in a case where a control signal is applied to the second electrode 11. The support layer 13 is displaced by an electrostatic force acting between the second electrode 11 and the first electrode 14 according to the control signal applied to the second electrode 11. Therefore, the leg portions of one end of the second capacitor 19 and one end of the inductor 20 are made into a contact state (each of the first and second MEMS switches is in the on (ON) state) at least two contacts. The leg portions of the other end of the second capacitor 19 and the other end of the inductor 20 are made into the contact state at least two contacts.

In this case, when the inductance L of the inductor 20, a capacitance $C_1$ of the first capacitor 17, and a capacitance $C_2$ of the second capacitor 19 are set so as to satisfy a relationship of "$f=\frac{1}{2}\pi\sqrt{C_1L}=\frac{1}{2}\pi\sqrt{C_2L}$" at a use frequency f, a high-frequency signal inputted from the first input and output terminal 15 is outputted to the second input and output terminal 21. At this time, the single-pole single-throw switch becomes an off (OFF) state.

FIG. 13 is a cross sectional view along the A-A' line of FIG. 12 in the case where the control signal is not applied to the second electrode 11. At this time, the single-pole single-throw switch becomes the on (ON) state.

Embodiment 5

Figure 15:
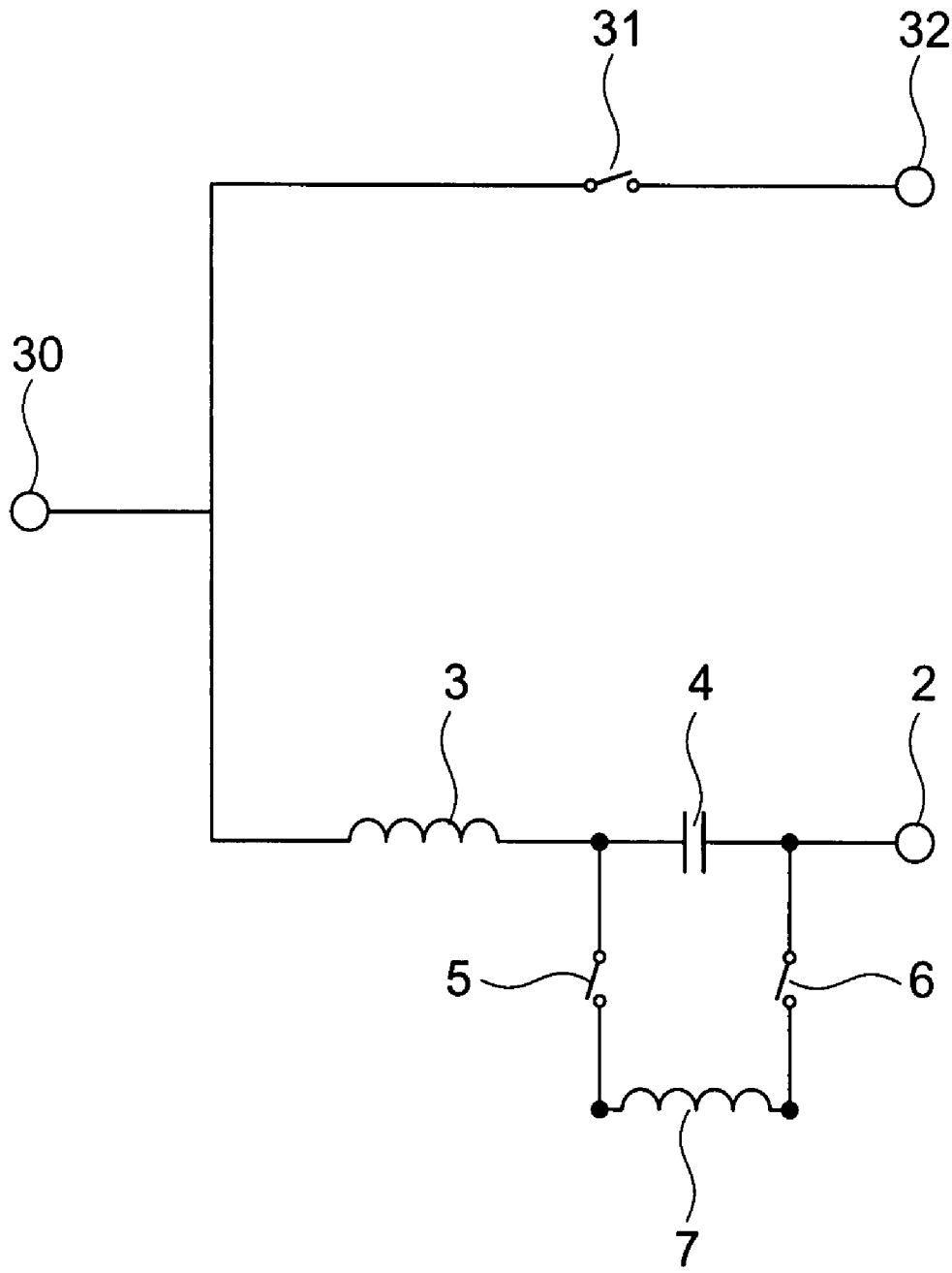
FIG. 15 is a circuit diagram showing a structure of a single-pole double-throw switch according to Embodiment 5 of the present invention.

A switch circuit according to Embodiment 5 of the present invention will be described with reference to FIGS. 15 to 17. FIG. 15 is a circuit diagram showing a structure of a single-pole double-throw switch according to Embodiment 5 of the present invention.

In FIG. 15, the single-pole double-throw switch according to Embodiment 5 includes an input terminal 30, a third MEMS switch 31, a second output terminal 32, the first inductor 3 connected with the input terminal 30, the capacitor 4 connected with the first inductor 3, a first output terminal 2 connected with the capacitor 4, the first MEMS switch 5 connected with one end of the capacitor 4, the second MEMS switch 6 connected with the other end of the capacitor 4, and the second inductor 7 connected between the first MEMS switch 5 and the second MEMS switch 6.

Next, the operation of the switch circuit according to Embodiment 5 will be described with reference to the drawings.

Figure 16:
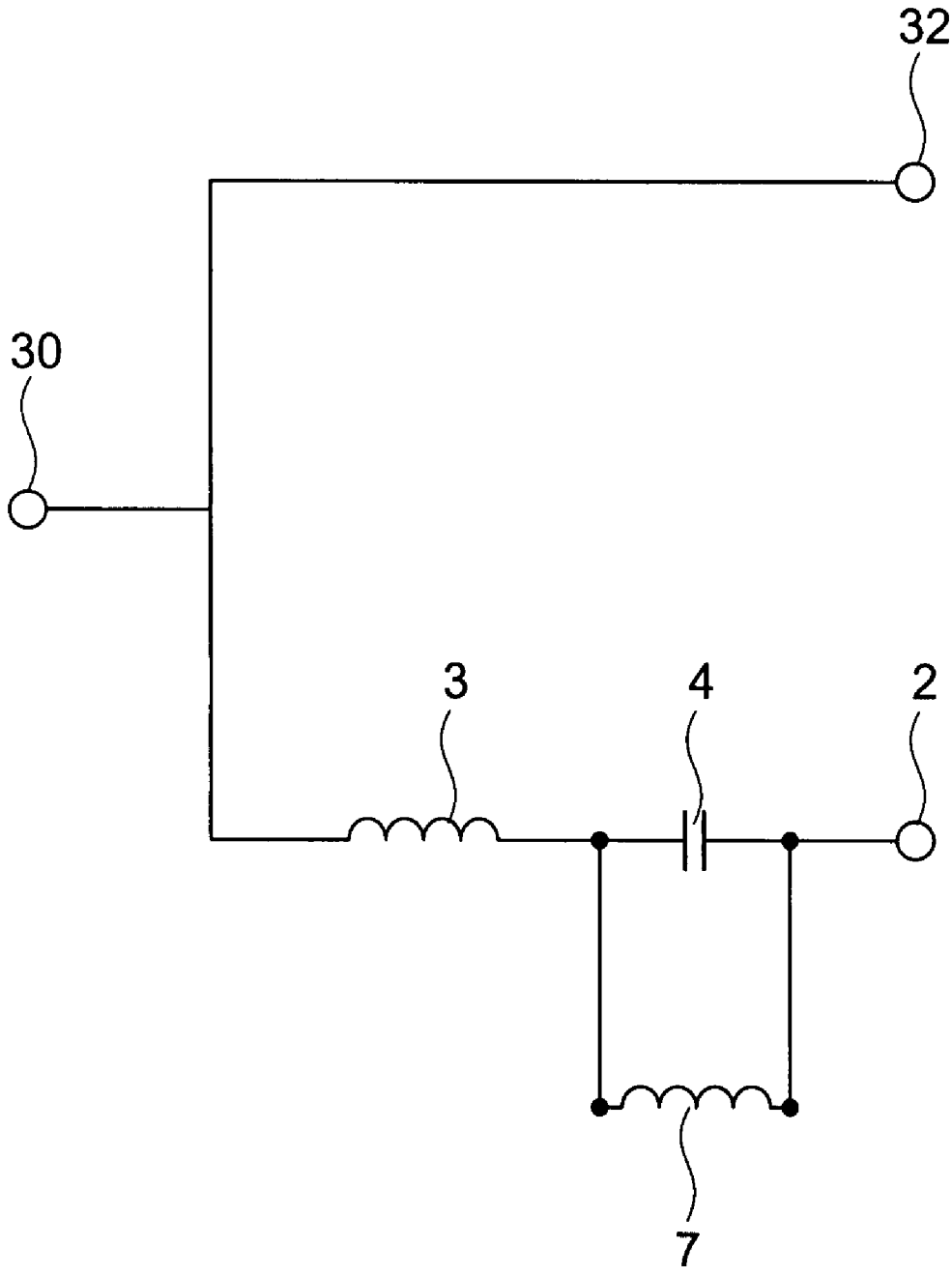
FIG. 16 is an equivalent circuit diagram showing the single-pole double-throw switch of FIG. 15.

FIG. 16 is an equivalent circuit diagram in the case where each of the first, second, and the third MEMS switches 5, 6, and 31 is in the on (ON) state. When the inductance $L_1$ of the first inductor 3, the inductance $L_2$ of the second inductor 7, and the capacitance C of the capacitor 4 are set so as to satisfy a relationship of "$f=\frac{1}{2}\pi\sqrt{CL_1}=\frac{1}{2}\pi\sqrt{CL_2}$" at the use frequency f, a high-frequency signal inputted from the input terminal 30 is outputted to the second output terminal 32.

Figure 17:
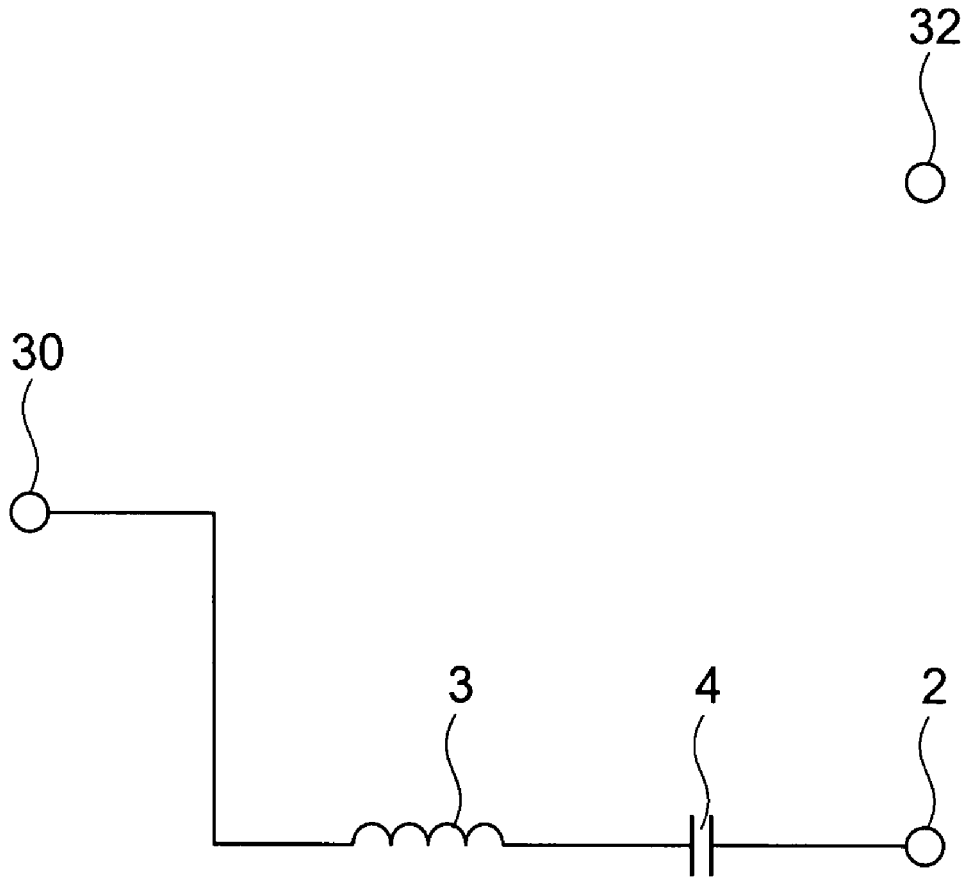
FIG. 17 is an equivalent circuit diagram showing the single-pole double-throw switch of FIG. 15.

FIG. 17 is an equivalent circuit diagram in the case where each of the first, second, and the third MEMS switches 5, 6, and 31 is in the off (OFF) state. At this time, the high-frequency signal inputted from the input terminal 30 is outputted to the first output terminal 2.

FIG. 15 shows an example of a single-pole double-throw switch which is composed of the single-pole single-throw switch according to Embodiment 1 and the MEMS switch 31. As described above, when the single-pole single-throw switch described in Embodiment 1 or 2 is combined with the MEMS switch, it is possible to construct a single-pole double-throw switch whose signal paths are switched in response to a control signal.

Embodiment 6

Figure 18:
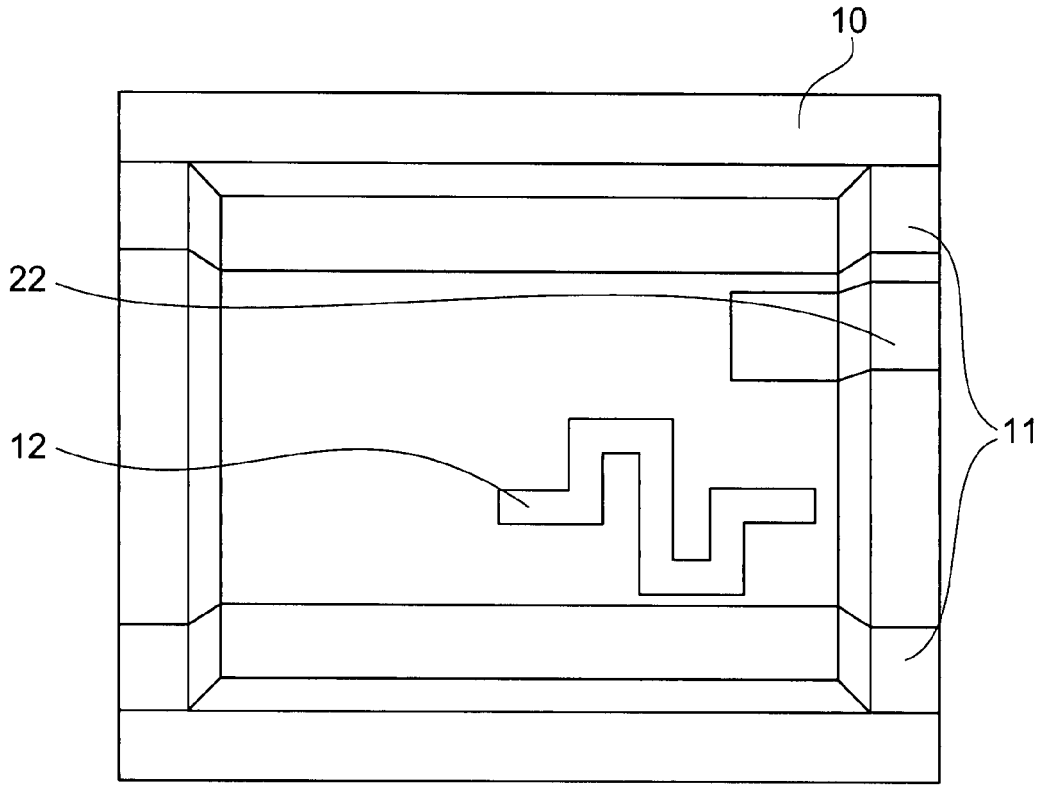
FIG. 18 is a plan view showing a structure of a single-pole double-throw switch according to Embodiment 6 of the present invention.
Figure 19:
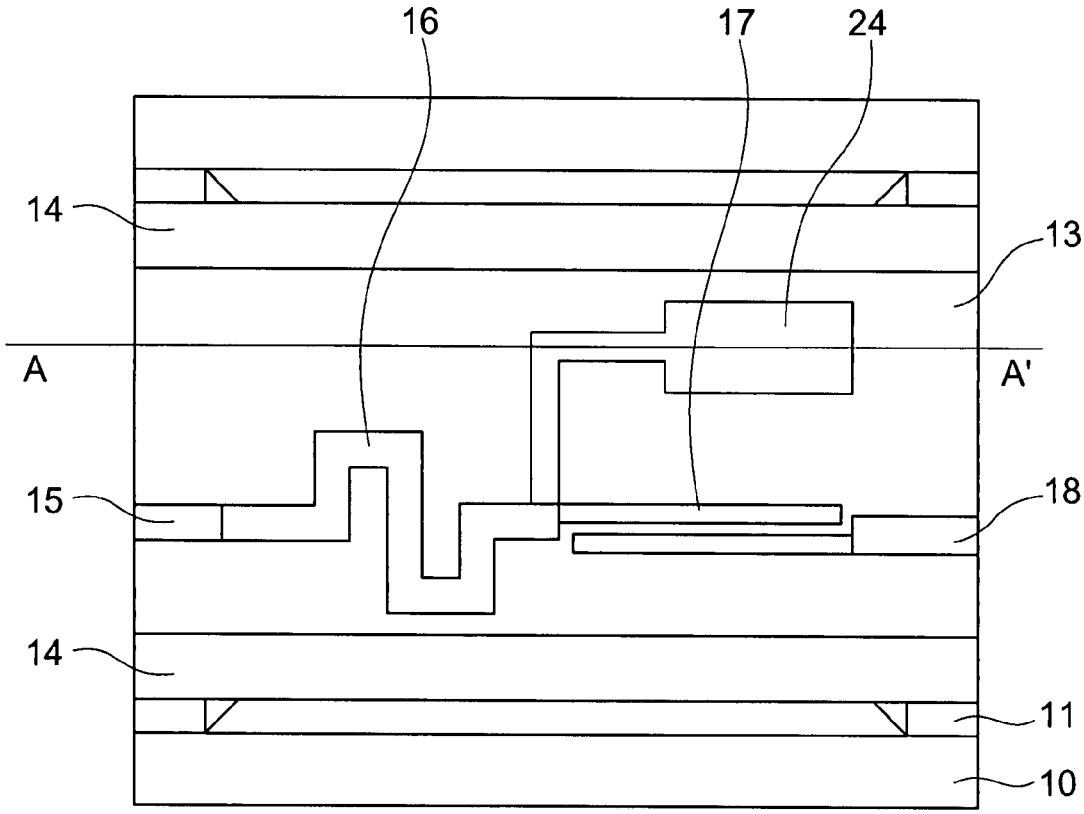
FIG. 19 is a plan view showing a structure of the single-pole double-throw switch according to Embodiment 6 of the present invention.

A switch circuit according to Embodiment 6 of the present invention will be described with reference to FIGS. 18 to 21. FIGS. 18 and 19 are plan views showing a structure of a single-pole double-throw switch according to Embodiment 6 of the present invention.

FIG. 18 is a structural view showing a single-pole double-throw switch which does not include the support film. FIG. 19 is a structural view showing a single-pole double-throw switch which includes the support film.

Figure 20:
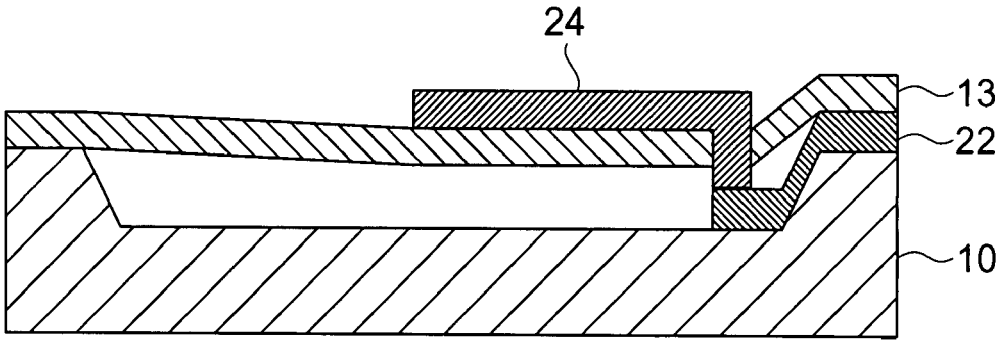
FIG. 20 is a cross sectional view showing an A-A' cross section of the single-pole double-throw switch of FIG. 19.
Figure 21:
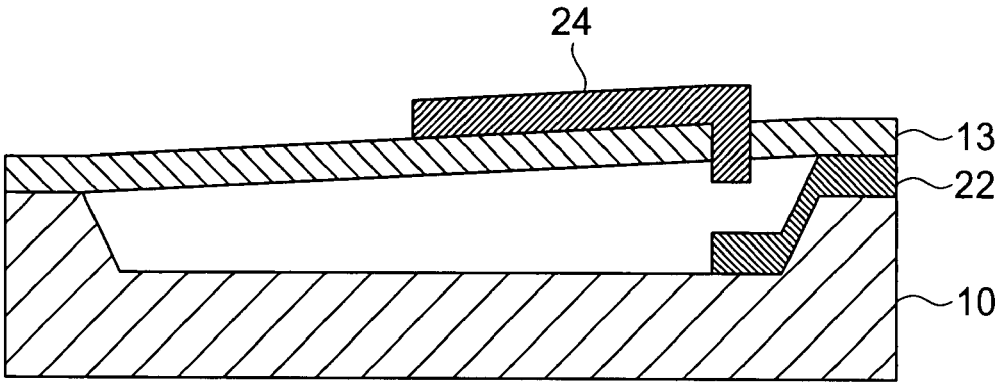
FIG. 21 is across sectional view showing the A-A' cross section of the single-pole double-throw switch of FIG. 19.

In FIGS. 18 and 19, the single-pole double-throw switch according to Embodiment 6 includes the substrate 10 whose central part has the rectangular concave portion (cavity) like a rectangular ashtray, the second electrode 11 formed in the concave portion, the second inductor 12 formed in the concave portion, a second output terminal 22 formed in the concave portion, the support film 13 formed on the substrate 10 so as to cover the concave portion, the first electrode 14 formed on the support film 13, the input terminal 15 formed on the support film 13, the first inductor 16 formed on the support film 13, the capacitor 17 formed on the support film 13, the first output terminal 18 formed on the support film 13, and an electrical connection metal pattern 24 formed on the support film 13. Note that a shape of each of the first inductor 16 and the first output terminal 18 is identical to that of each of the first inductor 16 and the second input and output terminal 18 as described in Embodiment 3. As shown in FIGS. 20 and 21 described later, a right end of the electrical connection metal pattern 24 extends through the support film 13 and serves as a leg portion thereof.

Next, the operation of the switch circuit according to Embodiment 6 will be described with reference to the drawings.

FIG. 20 is a cross sectional view along an A-A' line of FIG. 19 in the case where the control signal is applied to the second electrode 11. The support layer 13 is displaced by an electrostatic force acting between the second electrode 11 and the first electrode 14 according to the control signal applied to the second electrode 11. Therefore, one end of the capacitor 17 (that is, the leg portion of the first inductor 16) and one end of the second inductor 12 are made into a contact state (each of the first and second MEMS switches is in the on (ON) state) at least two contacts. The other end of the capacitor 17 (that is, the leg portion of the first output terminal 18) and the other end of the second inductor 12 are made into the contact state at least two contacts. The leg portion of the electrical connection metal pattern 24 and the second output terminal 22 are made into a contact state (the third MEMS switch is in the on (ON) state) at least one contact.

In this case, when the inductance $L_1$ of the first inductor 16, the inductance $L_2$ of the second inductor 12, and a capacitance C of the capacitor 17 are set so as to satisfy a relationship of "$f=\frac{1}{2\pi}\sqrt{CL_1}=\frac{1}{2\pi}\sqrt{CL_2}$" at a use frequency f, the high-frequency signal inputted from input terminal 15 is outputted to the second output terminal 22.

FIG. 21 is a cross sectional view along the A-A' line of FIG. 19 in the case where the control signal is not applied to the second electrode 11. At this time, the high-frequency signal inputted from the input terminal 15 is outputted to the first output terminal 18.

FIG. 19 shows an example of a single-pole double-throw switch which is composed of the single-pole single-throw switch according to Embodiment 3 and a MEMS switch. As described above, when the single-pole single-throw switch described in Embodiment 3 or 4 is combined with the MEMS switch, it is possible to construct a single-pole double-throw switch whose signal paths are switched in response to a control signal.

Two single-pole single-throw switches, each of which corresponds to one of Embodiments land 2, can be combined to construct a single-pole double-throw switch.

At least two single-pole single-throw switches, each of which corresponds to one of Embodiments 1 and 2, can be combined to construct a multi-pole multi-throw switch.

Two single-pole single-throw switches, each of which corresponds to one of Embodiments 3 and 4, can be combined to construct a single-pole double-throw switch.

At least two single-pole single-throw switches, each of which corresponds to one of Embodiments 3 and 4, can be combined to construct a multi-pole multi-throw switch.

The invention claimed is:

1. A switch circuit, comprising:

a substrate including a cavity;

a second electrode formed to a surface of the cavity;

a second inductor formed to the surface of the cavity;

a support film formed on the substrate to cover a space of the cavity;

a first electrode formed on the support film;

a first input and output terminal formed on the support film;

a first inductor which is formed on the support film and connected with the first input and output terminal;

a capacitor which is formed on the support film and connected with the first inductor;

a second input and output terminal which is formed on the support film and connected with the capacitor; and first and second MEMS switches for displacing the support film by an electrostatic force acting between the second electrode and the first electrode in response to a control signal applied to the second electrode to make one end of the first inductor and one end of the second inductor into one of a contact state and a non-contact state and to make the second input and output terminal and the other end of the second inductor into the one of the contact state and the non-contact state, wherein a relationship of $f=1/(2\pi\sqrt{CL_1})=1/(2\pi\sqrt{CL_2})$ is satisfied, where $L_1$ is an inductance of the first inductor, $L_2$ is an inductance of the second inductor, C is a capacitance of the capacitor, and f is a use frequency.

2. A switch circuit, comprising:

a substrate including a cavity;

a second electrode formed to a surface of the cavity;

a second capacitor formed to the surface of the cavity;

a support film formed on the substrate to cover a space of the cavity;

a first electrode formed on the support film;

a first input and output terminal formed on the support film;

an inductor which is formed on the support film and connected with the first input and output terminal;

a first capacitor which is formed on the support film and connected with the inductor;

a second input and output terminal which is formed on the support film and connected with the first capacitor; and first and second MEMS switches for displacing the support film by an electrostatic force acting between the second electrode and the first electrode in response to a control signal applied to the second electrode to make one end of the inductor and one end of the second capacitor into one of a contact state and a non-contact state and to make the other end of the inductor and the other end of the second capacitor into the one of the contact state and the non-contact state, wherein a relationship of $f=1/(2\pi\sqrt{CL_1})=1/(2\pi\sqrt{CL_2})$ is satisfied, where L is an inductance of the inductor, $C_1$ is a capacitance of the first capacitor, $C_2$ is a capacitance of the second capacitor, and f is a use frequency.

3. A switch circuit, comprising:

the switch circuit according to claim 1;

a second output terminal formed to the surface of the cavity;

an electrical connection metal pattern which is formed on the support film and connected with the first inductor; and a third MEMS switch for displacing the support film by an electrostatic force acting between the second electrode and the first electrode in response to a control signal applied to the second electrode to make an end of the electrical connection metal pattern and the second output terminal into one of a contact state and a non-contact state, wherein the first and second input and output terminals serve as the input terminal and the first output terminal and the switch circuit serves as a single-pole double-throw switch.

4. A switch circuit, comprising a combination of two switch circuits, each of which is the switch circuit according to claim 1 or 2, wherein the switch circuit serves as a single-pole double-throw switch.

5. A switch circuit, comprising a combination of two switch circuits, each of which is the switch circuit according to claim 1 or 2, wherein the switch circuit serves as a multi-pole multi-throw switch.

* * * * *